US008746682B2

(12) United States Patent
Suleiman

(10) Patent No.: US 8,746,682 B2
(45) Date of Patent: Jun. 10, 2014

(54) LARGE CAPACITY AUTOMATIC PAPER TRAY

(75) Inventor: Tareq E. A. Suleiman, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 13/990,032

(22) PCT Filed: May 7, 2011

(86) PCT No.: PCT/US2011/035664

§ 371 (c)(1),
(2), (4) Date: May 28, 2013

(87) PCT Pub. No.: WO2012/154163

PCT Pub. Date: Nov. 15, 2012

(65) Prior Publication Data

US 2013/0241140 A1 Sep. 19, 2013

(51) Int. Cl.
*B65H 1/00* (2006.01)
*B65H 1/08* (2006.01)

(52) U.S. Cl.
USPC ..... 271/145; 271/147; 271/162

(58) Field of Classification Search
USPC ..... 271/145, 147, 162
See application file for complete search history.

(56) References Cited

U.S. PATENT DOCUMENTS 5,152,520 A 10/1992 Farrell et al.
5,219,158 A * 6/1993 Kilian et al. ..... 271/207
5,620,269 A 4/1997 Gustafson
5,794,928 A * 8/1998 Araseki et al. ..... 271/9.08
6,286,827 B1 9/2001 Meetze, Jr. et al.

FOREIGN PATENT DOCUMENTS

JP 2002-229285 8/2002

* cited by examiner

*Primary Examiner* — Luis A Gonzalez
(74) *Attorney, Agent, or Firm* — Richard C Litman

(57) ABSTRACT

A large capacity automatic printer paper tray operatively mounts a printing device to its upper extent. A paper support is disposed in a frame of the paper tray and is slideably supported by vertical frame rails. A drive screw rotatably secured in the frame is operatively coupled to the paper support. An actuator motor operatively drives the drive screw to raise and lower the paper support. Lower and upper limit sensors control the motor to limit downward and upward movement of the paper support. A paper pick-up interface plate transfers a top paper from the paper support into a paper pick-up roller of the mounted print device, via a feed roller of the print device. A pull-track sensor operates the motor to maintain a top level of paper on the paper support between a minimum and a maximum pull-track threshold.

19 Claims, 6 Drawing Sheets

400

500

LARGE CAPACITY AUTOMATIC PAPER TRAY

BACKGROUND

In situations where a high volume of documents are printed, the filling of a typical printer paper tray can be onerous, and in situations where controlled paper, such as watermarked or otherwise stamped paper is used, frequent refilling can present security concerns. Such issues often arise in printer kiosk situations, such as may be present on a school campus or the like.

Furthermore, in situations where typical low volume paper trays are used for high volume printing, maintenance issues may arise. For example, paper jams due to misfeeds are more common when paper levels are low. Also, damage to paper tray components, such as the tray's paper sensor flag may be more prevalent if the paper tray is repeatedly refilled, or filled to above capacity, due to frequent exhaustion of the paper supply.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The described systems and methods relate to a large capacity automatic printer paper tray comprising a frame having a plurality of vertical rails. The frame selectively operatively mounts a printer or other printing device to its upper extent. A paper support is slideably disposed in the frame, slideably supported by the vertical rails. A drive screw is rotatably secured in the frame and operatively coupled to the paper support. An actuator motor operatively drives the drive screw to raise and lower the paper support. A lower limit sensor controls the actuator motor to limit downward movement of the paper support and an upper limit sensor controls the actuator motor to limit upward movement of the paper support. A paper pick-up interface plate transfers a top paper from the paper support into a paper pick-up roller of the mounted print device via a feed roller of the print device. A pull-track sensor operates the actuator motor to maintain a top level of paper on the paper support between a minimum and a maximum pull-track threshold.

BRIEF DESCRIPTION OF THE DRAWINGS

The detailed description is set forth with reference to the accompanying figures, in which the left-most digit of a reference number identifies the figure in which the reference number first appears. The use of the same reference numbers in different figures indicates similar or identical items or features.

DETAILED DESCRIPTION

Overview

Figure 1:
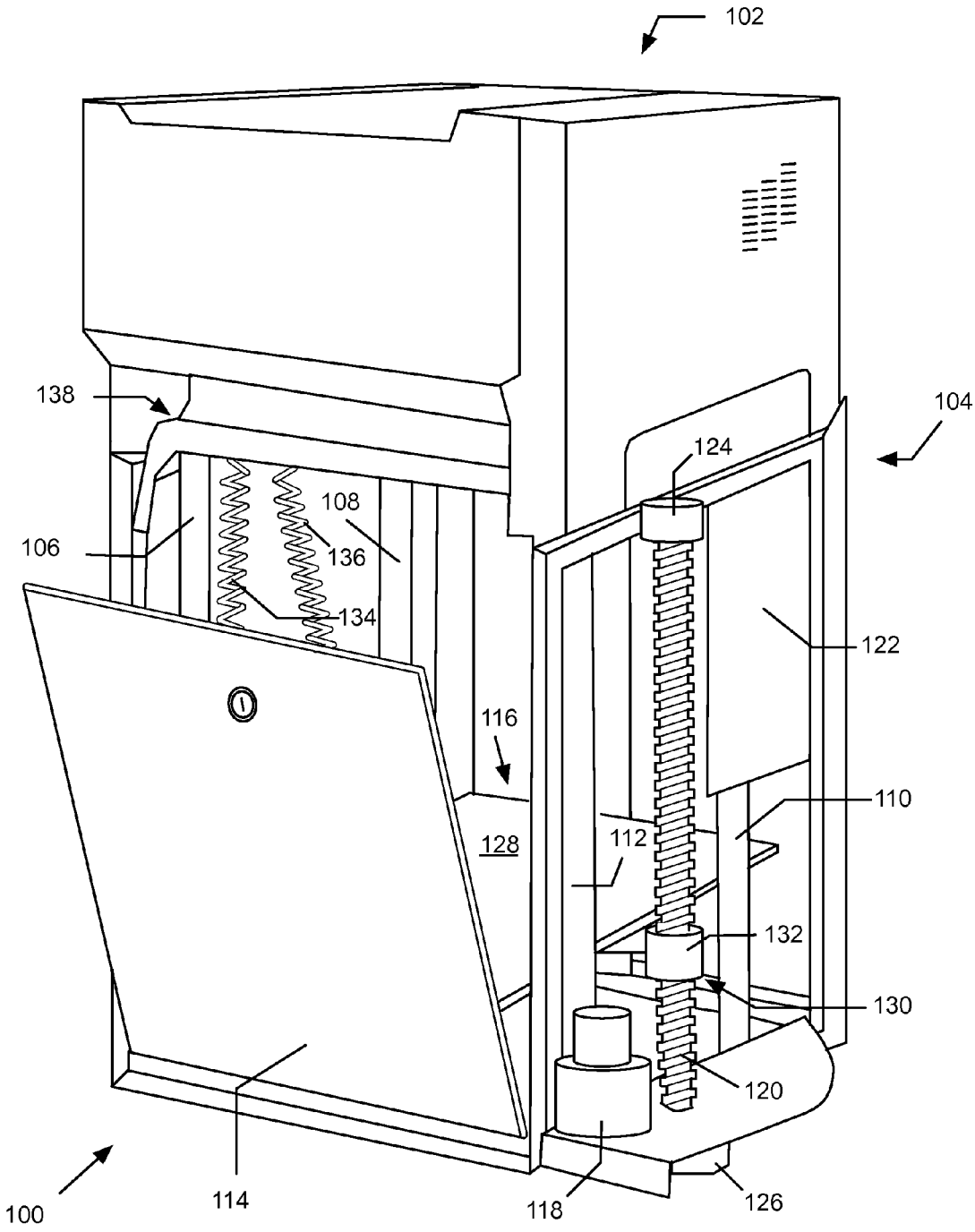
FIG. 1 is a fragmented perspective view of an example large capacity automatic printer paper tray, mounting a printer, according to one embodiment.

The systems and methods described herein relate to large capacity automatic printer paper trays adapted for use with existing laser printers or the like. The present large capacity automatic printer paper tray is particularly well suited for use in self-service printers, such as the printers used in college campus kiosks and similar situations. For example, the present large capacity automatic paper tray may be of particular use in different applications that give more efficiently in self-service situations such as kiosks printers, lab printers, library printer, public use printers, large volume and/or high speed printers, department printers; workgroup printers, and/or domain printers.

In accordance with various implementations, the large capacity paper stack in the automatic paper tray is on the order of thousands of sheets, for example in excess of four-thousand sheets. Typical expanded capacity automatic paper trays hold up to two thousand sheets and are limited to use in a small range of printer's within the manufacture's product line.

In accordance with various embodiments, the dimension of the top of the large capacity automatic paper tray is similar to the original paper tray of the printer mounted on the large capacity automatic paper tray. Therefore, when the printer is fixed (without its original paper tray) onto the top of the present large capacity automatic paper tray, the top level of paper inside large capacity automatic paper tray is positioned similar to the top level of papers inside original paper tray of the printer.

The present large capacity automatic paper tray is adapted to permit pulling of a top sheet of paper from a fixed range of pages at the top of a large capacity paper stack housed within the tray. This top range of pages contains four to eight sheets of paper and is referred to herein as the "pull-track range." In accordance with various embodiments, the top sheet is pulled into the paper pick-up roller of the printer, via the printer's paper pull roller. In accordance with various implementations, the pull-track range of the large capacity automatic paper tray is adaptive and is maintained to be small compared to the range of paper the paper feed roller of the printer can typically handle. As a result, the paper feed roller of the printer mounted on the large capacity automatic paper tray is insensitive to the decrease or increase of the level of papers in the large capacity automatic paper tray. Thus, implementations of the large capacity automatic paper tray employ long vertical motion to feed the paper into the paper pick-up roller in the mounted printer, rather than typical horizontal feeder using multiple small paper tray drawers.

The large capacity automatic paper tray is adapted to be compatible with popular printers. To this end, operation of the mechanism of the large capacity automatic paper tray is largely independent of the mounted printer. The printer only interacts with the pull-track range of paper. As a result, embodiments of the large capacity automatic paper tray can be used with any number of printer models, with little adjustment for each printer model. Printer parts generally do not last indefinitely. Therefore, in accordance with various implementations, the printer mounted on the present large capacity automatic paper tray can be replaced with another printer without changing the large capacity automatic paper tray.

Advantageously, paper inside the large capacity automatic paper tray may be locked, using a physical lock. This may be particularly advantageous in situations where the paper has a specific watermark, official stamp, and logo or the like, such as may be employed for official or controlled documents.

The large capacity automatic paper tray is a cost-effective solution that generally occupies the same footprint as the mounted printer. Also, if a supporting paper cabinet for the original printer is taken into account, the present large capacity automatic paper tray mounting a printer does not occupy any greater volume.

The present large capacity automatic paper tray may minimize maintenance since refilling is reduced. Particular examples discussed herein have an ability to handle a large number of sheets, for example up to 4444 sheets of paper. Thus, it provides an increase in up time and simultaneously reduces the frequency of paper refills.

Particular examples of the large capacity automatic paper tray discussed herein are generally employed with a laser printer of the like. However, the present large capacity automatic paper tray may also be adapted for use with other types of printers such as inkjet printers and/or with other types of devices such as copiers or printing presses.

Exemplary Large Capacity Automatic Paper Tray

FIG. 1 is a fragmented perspective view of example large capacity automatic printer paper tray 100 mounting printer 102, according to one embodiment. FIG. 1 is fragmented in that side covers and the like are not sown, such that the interior operational components of large capacity automatic printer paper tray 100. Large capacity automatic paper tray 100 comprises frame 104, which in turn may include a plurality of vertical rails 106-112. Frame 104 selectively (e.g., removably) operatively mounts a printing device, such as illustrated printer 102 to its upper extent (also see FIG. 2. Frame 104 may further comprise an outer housing that may include an outer case (not shown for purposes of clarity) that has lockable door 114. Paper support 116 is slideably disposed in frame 104 and slideably supported by vertical rails 106-112. For example, paper support 116 may be slideably fixed to vertical rails, via sliding bearings (not shown) disposed in bearing sheaths (see FIG. 3). Any appropriate number of vertical rails may be used in large capacity automatic paper tray 100, however as illustrated four rails, with a pair of rails disposed on an opposite sides of the paper support, is one arrangement of rails that may be used.

Figure 3:
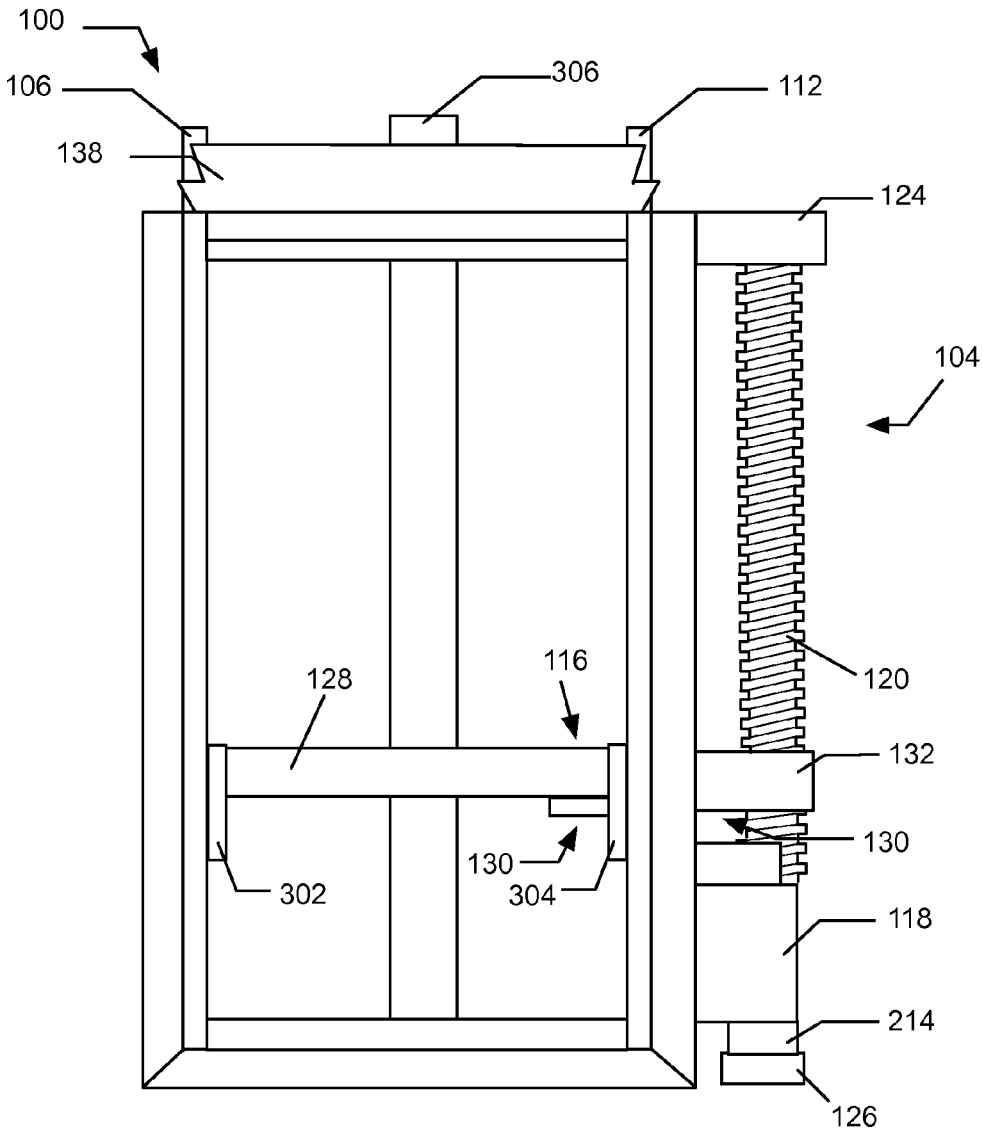
FIG. 3 is a fragmented front view of the example large capacity automatic printer paper tray embodiments of FIGS. 1 and 2, according to one embodiment.

Actuator motor 118 may be used to rotate one or more drive screws 120, such as via gear wheels (not shown) and a drive belt (see FIG. 3). In various embodiments the drive screw is made from a durable material such as stainless steel. Actuator motor 118 may be operatively controlled via circuitry 122 to operatively drive screw 120 to raise and lower paper support 116. Drive screw 120 is rotatably secured to frame 104, such as though the use of bearings 124 and 126 rotatably securing the ends of drive screw 120 at the top and bottom of frame 104, respectively, and operatively coupled to paper support 116.

Paper support 116 includes paper supportive platform 128 slideably supported by vertical rails 106-112 and paper support base 130 fixed to paper support platform 128. The sliding paper support platform 128 may be made of a light metal and sized to handle a specific paper size, or may be adjustable to accommodate a range of paper sizes. The sliding paper support platform 128 extends across vertical rails 106-112 and is used to move the paper stack up and down. The paper support is slideably fixed to the four rails 106-112, via slide bearings (See FIG. 3). Paper support base 130 also extends from paper support platform 128 to threadably receive drive screw 120. For example, casing 132 may define internal threads (not visible), which mate with drive screw 120 for moving platform 128 up and down in frame 104.

One or more tension springs 134 and 136 may extend from one or more upper points on frame 104 to paper support 116 to bias paper support 116 upward when paper support 116 is below a preselected height within frame 104. These one or more pull springs may be used to assistant to move sliding paper support 116. Pull springs 134 and 136 may balance movement of the sliding paper support 116 on an opposite side from drive screw 120. In accordance with various implementations, when the paper tray is full, pull springs 134 and 136 are active to balance the load imparted by the weight of the paper. As paper is depleted and the sliding paper support rises, pull springs 134 and 136 are under less tension, and thereby become less active.

Figure 2:
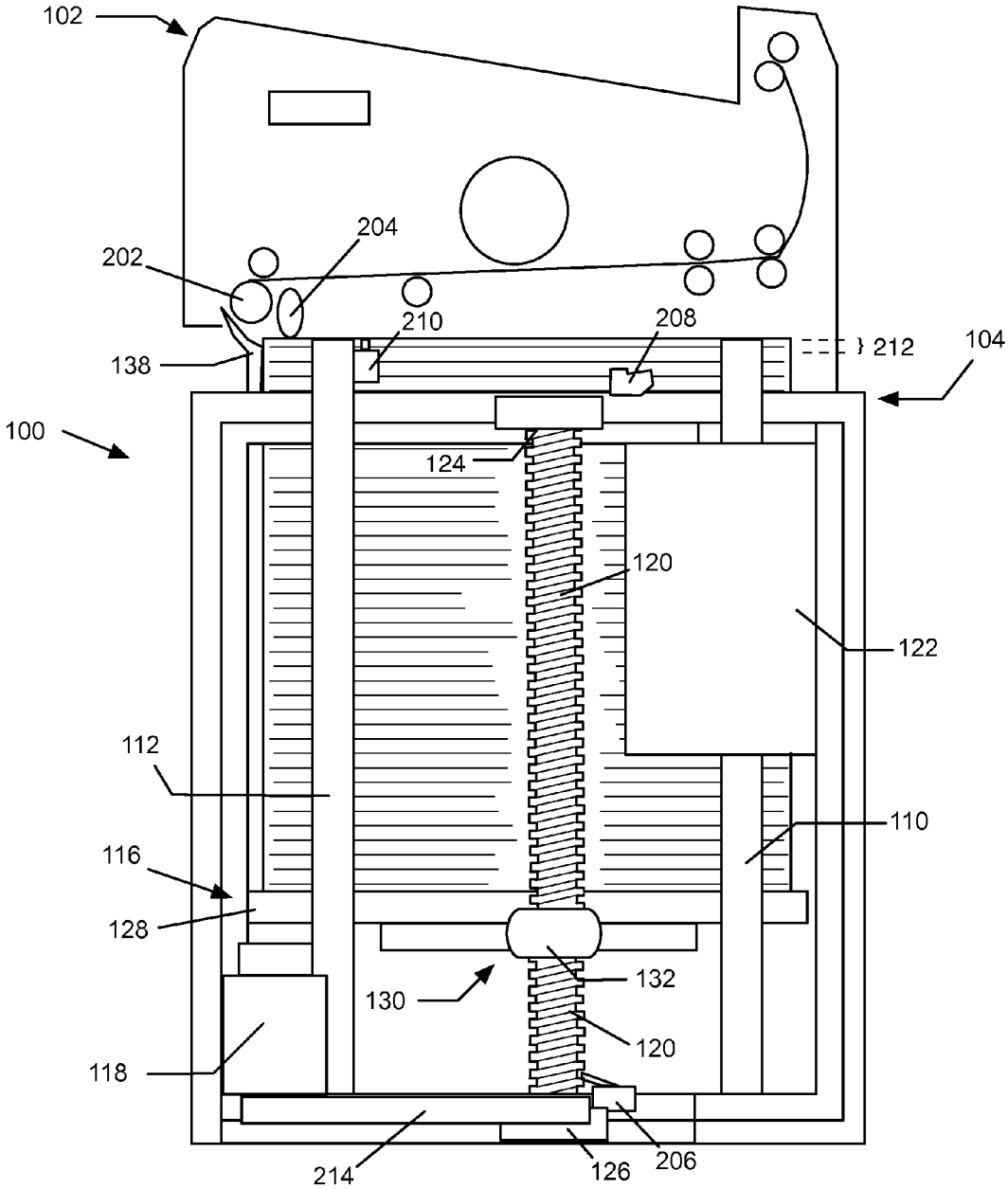
FIG. 2 is a fragmented side view of the example large capacity automatic printer paper tray embodiment of FIG. 1, shown mounting a fragmented printer, according to one embodiment.

Paper pick-up interface plate 138 transfers a top paper from paper support 116 into a paper pick-up roller of the mounted printer, via a feed roller of the printer. FIG. 2 is a fragmented side view of example large capacity automatic printer paper tray embodiment 100 of FIG. 1, shown mounting fragmented printer 102, according to one embodiment. To enable transformation of a top paper from paper support 116 into paper pick-up roller 202 of mounted printer 102, via feed roller 204 of printer 102, pick-up interface plate 138 may be fixed between a front of the high capacity automatic large capacity automatic paper tray and paper pick-up roller 202 of mounted printer 102.

In accordance with various embodiments the limit control comprises lower limit sensor switch 206 and upper limit sensor 208. Lower limit sensor 206 controls actuator motor 118, via circuitry 122, to limit downward movement of paper support 116. Lower limit sensor 206 operates to stop downward movement of paper support 116 when the paper support base 130 and hence paper support 116, arrives at a maximum lower movement limit. Upper limit sensor 208 controls actuator motor 118, via circuitry 122, to limit upward movement of paper support 116. Upper limit sensor 208 acts to stop upward movement of paper support 116 when the top level of the top sheet of paper reaches an upper threshold. These limit sensors may take the form of contact switches, which are operated by coming into contact with a surface of the paper, paper support platform 128 or paper support base 130. Alternatively, the limit sensors may take any other suitable form, such as optical, electromagnetic, or the like.

Pull-track control of large capacity automatic printer paper tray 100 includes pull-track sensor 210 that permits the level of top paper sheets to fall within the aforementioned pull-track range 212. In accordance with various implementations, pull-track sensor 210 detects the level of top paper sheets at both a maximum and minimum threshold. In specific implementations, pull-track range 212 does not exceed, by way of example, approximately 1.2 mm, which is about the thickness of 10 sheets of 80 g/m$^2$ paper and/or within a Maximum range of about 1.0-1.4 mm or about the thickness of about 8-12 sheets of 75-85 g/m$^2$ paper. Pull-track sensor 210 operates actuator motor 118 to maintain a top level of paper on paper support 116 between a minimum and maximum pull-track threshold. Pull-track sensor 212 operates actuator motor 118, via circuitry 122, to raise the paper support 116 in response to a top level of paper on paper supportive platform 128 reaching a minimum pull-track threshold, and to stop raising of paper supportive platform 128 in response to the top level of paper on paper supportive platform 128 reaching the maximum pull-track threshold.

As mentioned above, actuator motor 118 may rotate drive screw 120, such as via gear wheels (not shown) and drive belt 214. The ratio of the gear wheels may be used to decrease the speed of actuator motor 118 to a suitable speed for operation of drive screw 120. In some implementations, the gear wheels and/or drive belt 214 may also absorb torque of the motor if an overload occurs.

FIG. 3 is a fragmented front view of example large capacity automatic printer paper tray embodiment 100 of FIGS. 1 and 2, shown without a mounted printer, according to one embodiment. Therein, paper support platform bearing sheaths 302 and 304 can be more clearly seen as well rear vertical frame member 306.

Exemplary Procedures for Operation

Figure 4:
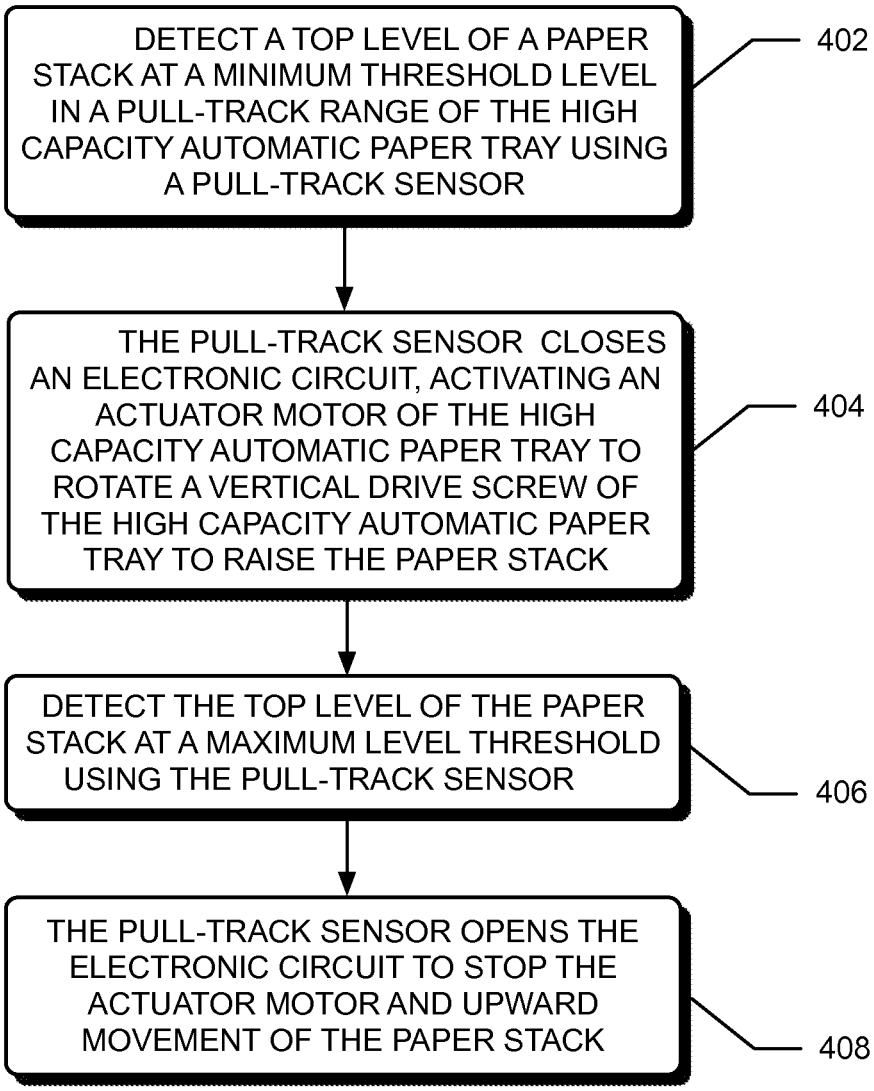
FIG. 4 shows an example procedure for operation of a large capacity automatic printer paper tray, according to one embodiment.

FIG. 4 shows example procedure 400 for operation of a large capacity automatic printer paper tray according to one embodiment. In this example, paper is maintained at a level sufficient to provide paper in the pull-track range using maximum and minimum thresholds. When a top level of paper inside paper tray decreases to the minimum threshold, pull-track sensor 210 operates to moves the top level of paper to the maximum threshold level. The top level of papers in the pull-track range is detected automatically, as follows. At 402, pull-track sensor 210 detects the top level of papers at a minimum threshold level. The pull-track sensor closes an electronic circuit, activating actuator motor 118 at 404. Actuator motor 118 drives the aforementioned gears, thereby rotating vertical drive screw 120. As noted, drive screw 120 converts this rotation into linear vertical motion of paper support 116, via sliding paper support base 130. Sliding paper support platform 128 moves the paper inside high capacity automatic paper tray 100 up. Pull-track sensor 210 detects when the top level of paper reaches the maximum level threshold at 406. As a result, at 408, pull-track sensor 210 opens the electronic circuit of actuator motor 118 to stop motion of the paper stack.

Figure 5:
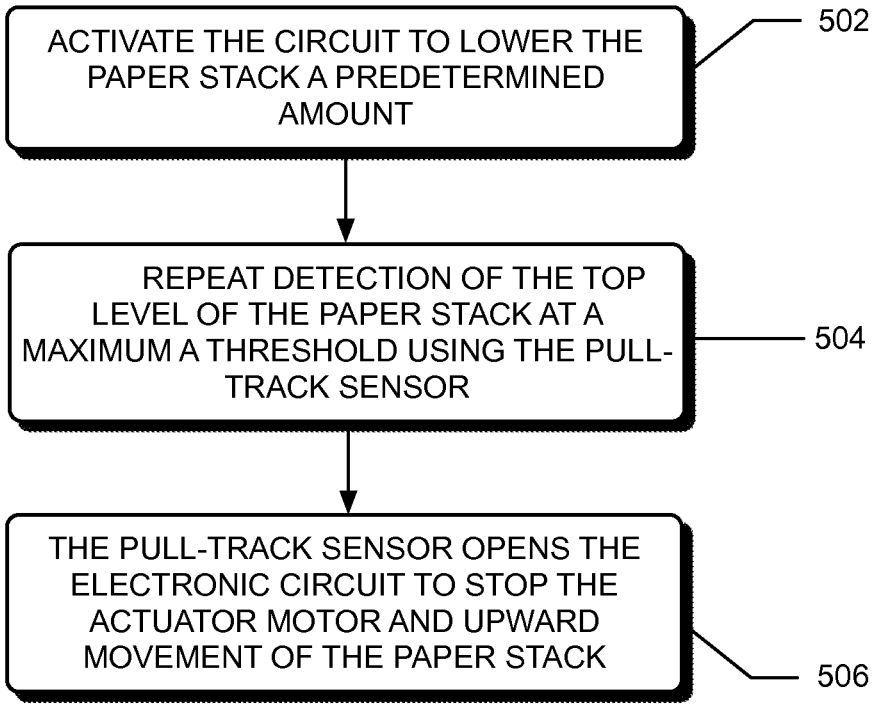
FIG. 5 shows an example procedure for further operation of a large capacity automatic printer paper tray, according to one embodiment.

In accordance with various embodiments, the top level of papers returns twice to pull-track range 212. For example, FIG. 5 shows example procedure 500 for further operation of a large capacity automatic printer paper tray according to one embodiment, wherein the circuit is again activated at 502 to lower the paper stack, such as to a predetermined height within frame 104, or a predetermined distance. Then, at 504 detection of the top level of the paper stack at a maximum level threshold using pull-track sensor 210 is repeated. Pull-track sensor 210 again opens the electronic circuit at 506 to stop the actuator motor and stop upward movement of the paper stack.

An Exemplary Procedure for Installation

Figure 6:
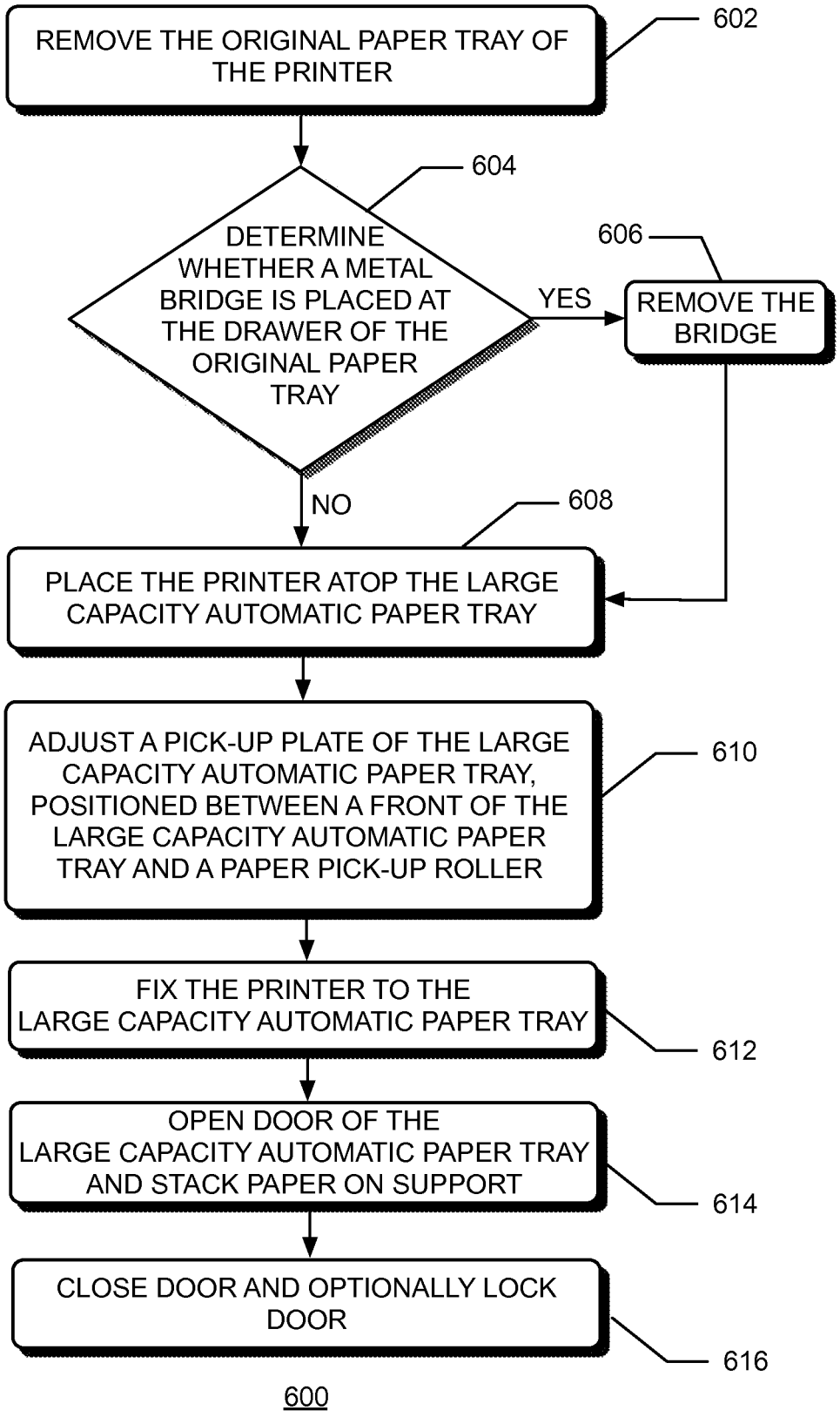
FIG. 6 shows an example procedure for mounting a printer on a large capacity automatic printer paper tray, according to one embodiment.

FIG. 6 shows an example procedure 600 for mounting printer 102 on large capacity automatic printer paper tray 100, according to one embodiment. At 602, the printer's original paper tray is removed. A determination is made at 604 as to whether a metal bridge is placed at the drawer of the original paper tray. If such a bridge is present, it is removed at 606. Regardless, at 608, printer 102 is placed atop large capacity automatic paper tray 100. Pick-up plate 138, positioned between the front of large capacity automatic paper tray 100 and paper pick-up roller 202 in printer 102, is adjusted at 610 to provide proper feeding of paper from pull-track range 212 of large capacity automatic printer paper tray 100, via feed roller 204 of printer 102. At 612, the printer is fixed to the tray, such as by sliding the printer onto the top of the tray from back to front. At 614, the door of the high capacity printer tray is opened, if not already open, and the tray is filled with paper by stacking the paper on paper support 116. The door is then closed, and optionally locked at 614.

Alternate Embodiments

Although the systems and methodologies related to a large capacity automatic printer paper tray have been described herein with respect to use with a laser printer or the like, it is understood that the implementations defined in the appended claims are not necessarily limited to the specific features or actions described. For example, the present large capacity automatic printer paper tray may be adapted for use with any number of printers, copies, or the like. Accordingly, the specific features and operations of the described systems and methods are disclosed as exemplary forms of implementing the claimed subject matter.

The invention claimed is:

1. A paper tray comprising:

a frame comprising vertical rails, the frame selectively operatively mounting a printing device to its upper extent;

a paper support slideably disposed in the frame, and slideably supported by the vertical rails;

a drive screw rotatably secured to the frame and operatively coupled to the paper support;

an actuator motor operatively driving the drive screw to raise and lower the paper support;

a lower limit sensor that controls the actuator motor to limit downward movement of the paper support;

an upper limit sensor that controls the actuator motor to limit upward movement of the paper support;

a paper pick-up interface plate transfers a top paper from the paper support into a paper pick-up roller of the mounted printing device via a feed roller of the printing device; and a pull-track sensor that operates the actuator motor to maintain a top level of paper on the paper support between a minimum and maximum pull-track threshold.

2. The paper tray of claim 1, wherein the frame further comprises an outer housing that includes an outer case having a lockable door.

3. The paper tray of claim 1, wherein the vertical rails includes four corner rails.

4. The paper tray of claim 1, wherein the vertical rails comprise two pair of vertical rails, each pair disposed on an opposite side of the paper support.

5. The paper tray of claim 1, wherein the paper support comprises a paper supportive platform slideably supported by the vertical rails and a paper support base fixed to the paper supportive platform threadably receiving the drive screw.

6. The paper tray of claim 1, wherein the paper support is slideably fixed to the vertical rails via sliding bearings.

7. The paper tray of claim 1, wherein the pick-up interface plate is fixed between a front of the paper tray and the paper pick-up roller of the mounted printing device.

8. The paper tray of claim 1, wherein the pull-track sensor operates the actuator motor to raise the paper support in response to the top level of the paper on the paper support reaching the minimum pull-track threshold and to stop raising of the paper support in response to the top level of the paper on the paper support reaching the maximum pull-track threshold.

9. The paper tray of claim 1, wherein the minimum and maximum pull-track threshold define a pull-track range of paper in the range of 1.0 to 1.4 mm thickness.

10. The paper tray of claim 1, wherein the minimum and maximum pull-track threshold define a pull-track range of paper in the range of 8 to 12 sheets of 75 to 85 g/m$^2$ paper.

11. The paper tray of claim 1, further comprising one or more tension springs extending from an one or more upper points on the frame to the paper support, biasing the paper support upward when the paper support is below a preselected height within the frame.

12. A method comprising:

detecting a top level of a paper stack at a minimum threshold level in a pull-track range of a high capacity automatic paper tray using a pull-track sensor;

the pull-track sensor closing an electronic circuit, activating an actuator motor of the high capacity automatic paper tray to rotate a vertical drive screw of the high capacity automatic paper tray to raise the paper stack;

detecting the top level of the paper stack at a maximum level threshold using the pull-track sensor; and the pull-track sensor opening, responsive to the detecting, the electronic circuit to stop the actuator motor and stop upward movement of the paper stack.

13. The method of claim 12, further comprising:

activating the circuit to lower the paper stack and repeating detecting the top level of the paper stack at a maximum level threshold using the pull-track sensor, and the pull-track sensor opening the electronic circuit to stop the actuator motor and stop upward movement of the paper stack.

14. The method of claim 12, wherein a maximum pull-track range is in the range of 1.0 to 1.4 mm.

15. The method of claim 12, wherein the maximum pull-track range is in the range of 8 to 12 sheets of 75 to 85 g/m$^2$ paper.

16. A method comprising:

removing an original paper tray of a printer;

determining whether a metal bridge is placed at the drawer of the original paper tray and if the bridge is present, removing the bridge;

placing the printer atop a large capacity automatic paper tray;

adjusting a pick-up plate of the large capacity automatic paper tray between a front of the large capacity automatic paper tray and a paper pick-up roller in the printer to provide feeding of paper from a pull-track range of the large capacity automatic printer paper tray, via a feed roller of the printer; and fixing the printer to the large capacity automatic paper tray.

17. The method of claim 16, wherein the fixing step comprises sliding the printer onto the top of the large capacity automatic paper tray from back to front.

18. The method of claim 16, further comprising opening a door of the large capacity automatic tray and filling the large capacity automatic paper tray with paper by stacking the paper on a paper support in the large capacity automatic paper tray.

19. The method of claim 18, further comprising closing the door and locking the door.

* * * * *